US009315242B2

(12) United States Patent
Veselis et al.

(10) Patent No.: US 9,315,242 B2
(45) Date of Patent: Apr. 19, 2016

(54) RELEASABLE MOORING SYSTEMS AND METHODS FOR DRILLING VESSELS

(71) Applicants: Todd B. Veselis, Cypress, TX (US); David E. Cobb, Cypress, TX (US); Thomas M. Fulton, Houston, TX (US); Mark Williamson, Katy, TX (US)

(72) Inventors: Todd B. Veselis, Cypress, TX (US); David E. Cobb, Cypress, TX (US); Thomas M. Fulton, Houston, TX (US); Mark Williamson, Katy, TX (US)

(73) Assignee: Intermoor Inc., Morgan City, LA (US)

( * ) Notice: Subject to any disclaimer, the term of this patent is extended or adjusted under 35 U.S.C. 154(b) by 301 days.

(21) Appl. No.: 13/742,853

(22) Filed: Jan. 16, 2013

(65) Prior Publication Data

US 2013/0183876 A1 Jul. 18, 2013

Related U.S. Application Data

(60) Provisional application No. 61/587,922, filed on Jan. 18, 2012.

(51) Int. Cl.
*B63B 22/02* (2006.01)
*B63B 35/44* (2006.01)

(52) U.S. Cl.
CPC ..... *B63B 22/02* (2013.01); *B63B 35/4413* (2013.01); *B63B 2022/028* (2013.01); *B63B 2241/10* (2013.01)

(58) Field of Classification Search
CPC B63B 21/502; B63B 35/4413; B63B 21/508; B63B 2021/505; B63B 21/50; E21B 19/002
USPC ..... 441/3–5; 114/230.12; 166/352–354
See application file for complete search history.

(56) References Cited

U.S. PATENT DOCUMENTS

| | | | | |
|---|---|---|---|---|
| 4,498,412 | A * | 2/1985 | Liden | 114/264 |
| 4,604,961 | A * | 8/1986 | Ortloff et al. | 114/230.12 |
| 4,646,672 | A | 3/1987 | Bennett et al. | |
| 4,995,762 | A * | 2/1991 | Goldman | 405/195.1 |
| 5,054,963 | A * | 10/1991 | Williamsson | 405/224 |
| 5,209,175 | A | 5/1993 | Cintron | |
| 5,542,783 | A * | 8/1996 | Pollack | 405/223.1 |
| 5,549,164 | A | 8/1996 | Blandford | |
| 5,809,925 | A | 9/1998 | Montgomery | |
| 6,009,825 | A | 1/2000 | Fulton | |
| 7,524,143 | B2 | 4/2009 | Loset et al. | |
| 2005/0013666 | A1 * | 1/2005 | Chianis et al. | 405/203 |
| 2009/0126617 | A1 | 5/2009 | Millheim | |
| 2011/0011329 | A1 | 1/2011 | Kim et al. | |
| 2011/0017511 | A1 | 1/2011 | Payne | |

FOREIGN PATENT DOCUMENTS

| | | | |
|---|---|---|---|
| EP | 0831022 | A1 | 3/1998 |
| KR | 10/2010/0003554 | A | 1/2010 |

OTHER PUBLICATIONS

International Search Report, PCT/US2013/021720, INTM:002PCT, Mar. 25, 2013, 3 pgs.

(Continued)

*Primary Examiner* — Edwin Swinehart
(74) *Attorney, Agent, or Firm* — Egan, Peterman, Enders & Huston, LLP

(57) ABSTRACT

Releasable mooring systems and methods for drilling vessels that may be implemented with dockable and releasable mooring buoys to provide for both a quick disconnect of the mooring system from a drilling vessel and for re-connection of the drilling vessel when the vessel returns to the well site.

22 Claims, 15 Drawing Sheets

(56) References Cited

OTHER PUBLICATIONS

STP, Submerged Turret Production, APL, Available on the Internet prior to the Jan. 18, 2012 filing date of the U.S. Appl. No. 61/587,922, to which the present application claims priority, 8 pgs.

STL, Submerged Turret Loading, APL, This reference describes technology publicly known prior to the Jan. 18, 2012 filing date of the U.S. Appl. No. 61/587,922, to which the present application claims priority, 8 pgs.

* cited by examiner

RELEASABLE MOORING SYSTEMS AND METHODS FOR DRILLING VESSELS

The present application claims priority to U.S. Provisional Patent Application Ser. No. 61/587,922 filed Jan. 18, 2012, the disclosure of which is incorporated herein by reference in its entirety.

FIELD OF THE INVENTION

This invention relates generally to mooring systems and methods for drilling vessels.

BACKGROUND

Stationkeeping for drillships and mobile offshore drilling units (MODUs) can be accomplished by providing mooring lines made up of chain, wire, synthetics or combinations of two or more. The top end of a typical mooring line is connected to the vessel using fairleads to change the mooring line direction and winches or chain jacks to tension and secure the mooring line. At the seafloor end of the mooring line, an anchor is provided; these typically can be a high-holding power drag embedment anchor, a suction pile, a plate anchor or driven pile.

Alternatively, the vessel can maintain station by dynamic positioning. Dynamic positioning (DP) typically entails the use of the main propulsion system of the vessel in combination with additional thrusters; the systems are controlled by computers and are linked to navigational aids such as GPS. In this way, the vessel can stay on location without the need for mooring lines and is able to move away from danger on a moment's notice.

For arctic conditions where drifting ice can pose a danger even during the summer drilling season, dynamic positioning (DP) would appear to be the stationkeeping method of choice. Experience has shown, however, that DP will not perform adequately in ice conditions. This leaves mooring systems for stationkeeping which are relatively slow to connect or disconnect; typically on the order of days to complete.

There are emergency release systems available on the market, but these systems simply drop the mooring system onto the seafloor. Re-connecting is therefore quite slow and can be complicated by fouled mooring chain and wire.

SUMMARY OF THE INVENTION

Disclosed herein are mooring systems and methods for drilling vessels, e.g., for mooring of exploratory drilling vessels in arctic ocean waters. The disclosed systems and methods may be implemented in one exemplary embodiment to provide for both a quick disconnect of the mooring system when danger approaches and relatively easy re-connect when the vessel returns to the well site. This may be achieved by connecting the mooring system using dockable buoys in lieu of directly connecting the mooring lines to the vessel. The dockable buoys may be designed for both easy disconnect and easy re-connect to the drilling vessel via receptacles either integral with the hull (e.g., in the case of a drillship) or external to the hull (e.g., in the case of a MODU).

In one exemplary embodiment, the disclosed systems and methods may be implemented in arctic drilling environments to provide a way for quickly disconnecting the mooring system from a drilling vessel when floating ice approaches, thereby allowing the drillship or MODU to drift in the ice. Once the drillship or MODU can be freed from the ice and safely returned to the drill site, the disclosed systems and methods provide a way of quickly reconnecting the mooring system and re-starting drilling operations.

It will be understood that the disclosed systems and methods may also be employed for mooring drilling vessels (including DP-equipped drilling vessels) in non-arctic drilling environments, such as in any situation where it is desirable to provide for relatively quick disconnection and later reconnection of a mooring system to a drilling vessel. Examples of such situations include, but are not limited to, mooring of a drilling vessel in hurricane-prone waters such as the Gulf of Mexico where storms may rapidly develop and require quick disconnection of the drilling vessel, followed by later return and re-connection to the mooring system for resumption of drilling operations. In another embodiment, the disclosed systems and methods may be employed for mooring DP-equipped vessels for drilling operations. In this embodiment, the releasable moorings are used to substantially reduce the time the vessel is actively using the DP system to maintain station. Advantages of this configuration includes reduced costs for DP fuel and maintenance, a much reduced carbon footprint while still maintaining the safety advantages of being able to quickly release the moorings and move the vessel out of harm's way.

In one respect, disclosed herein is a releasable mooring system for a seagoing drilling vessel. The system may include at least one dockable mooring buoy configured for coupling to one or more mooring lines anchored to a seafloor, with the mooring buoy having a buoyancy configured to float in the water at an equilibrium depth between a surface and the seafloor. The dockable mooring buoy may be configured to be engaged and retained in at least one retention feature provided on a seagoing drilling vessel to moor the vessel to the seafloor during drilling operations in which a drill string extends from the drilling vessel to the seafloor. The dockable mooring buoy may be further provided with a connection feature to allow a seagoing drilling vessel to connect to and retrieve the mooring buoy into selectable locking engagement with the retention feature to moor the vessel to the seafloor for the drilling operations. An opening may be defined through the mooring buoy to allow the drill string to pass through the mooring buoy to the seafloor to conduct drilling operations while the drilling vessel is moored to the seafloor by the mooring buoy, or multiple mooring buoys may be provided and configured for engagement and retention in multiple corresponding respective retention features provided on the drilling vessel in positions that provide clearance to allow the drill string to extend downward from the moored drilling vessel to conduct drilling operations while the drilling vessel is moored to the seafloor by the mooring buoys, or a combination thereof. The dockable mooring buoy may be configured to be selectably released from locking engagement with the retention feature to release the vessel from being moored to the seafloor.

In another respect, disclosed herein is a releasable mooring system and seagoing drilling vessel, including: a drilling vessel configured to conduct drilling operations below the surface of the water with a drill string; at least one dockable mooring buoy configured for coupling to one or more mooring lines anchored to a seafloor, the mooring buoy having a buoyancy configured to float in the water at an equilibrium depth between a surface and the seafloor; and at least one retention feature provided on a seagoing drilling vessel. The dockable mooring buoy may be configured to be engaged and retained in the at least one retention feature to moor the vessel to the seafloor during drilling operations in which the drill string extends from the drilling vessel to the seafloor. The dockable mooring buoy may be provided with a connection feature to allow the seagoing drilling vessel to connect to and retrieve the mooring buoy into selectable locking engagement with the retention feature to moor the vessel to the seafloor for the drilling operations; and the dockable mooring buoy may be further configured to be selectably released from locking engagement with the retention feature to release the vessel from being moored to the seafloor.

In another respect, disclosed herein is a method of conducting mooring operations for a seagoing drilling vessel, the method including: providing a drilling vessel on the surface of a body of water, the drilling vessel having at least one retention feature and the drilling vessel being configured to conduct drilling operations below the surface of the water with a drill string; providing at least one dockable mooring buoy coupled to one or more mooring lines anchored to a seafloor, the mooring buoy having a buoyancy configured to float in the water at an equilibrium depth between a surface and the seafloor; positioning the drilling vessel over the mooring buoy while the buoy is floating in the water at an equilibrium depth between a surface and the seafloor; using a connection feature to connect to and retrieve the mooring buoy, and engaging and retaining the dockable mooring buoy into locking engagement with the retention feature to moor the vessel to the seafloor; conducting drilling operations from the drilling vessel with the drill string extended from the drilling vessel to the seafloor while the mooring buoy is engaged and retained in the at least one retention feature to moor the vessel to the seafloor; and releasing the dockable mooring buoy from locking engagement with the retention feature to release the vessel from being moored to the seafloor.

In another respect, disclosed herein is a method of conducting mooring operations for a seagoing drilling vessel, the method including: providing a drilling vessel on the surface of a body of water, the drilling vessel having at least one retention feature and the drilling vessel being configured to conduct drilling operations below the surface of the water with a drill string; providing at least one dockable mooring buoy coupled to one or more mooring lines anchored to a seafloor, the mooring buoy having a buoyancy configured to float in the water at an equilibrium depth between a surface and the seafloor; positioning the drilling vessel over the mooring buoy while the buoy is floating in the water at an equilibrium depth between a surface and the seafloor; using a connection feature to connect to and retrieve the mooring buoy, and engaging and retaining the dockable mooring buoy into locking engagement with the retention feature to moor the vessel to the seafloor; and releasing the dockable mooring buoy from locking engagement with the retention feature to release the vessel from being moored to the seafloor. In the practice of the method, an opening may be defined through the mooring buoy to allow the drill string to pass through the mooring buoy to the seafloor to conduct drilling operations while the drilling vessel is moored to the seafloor by the mooring buoy; or multiple mooring buoys may be provided and configured for engagement and retention in multiple corresponding respective retention features provided on the drilling vessel in positions that provide clearance to allow the drill string to extend downward from the moored drilling vessel to conduct drilling operations while the drilling vessel is moored to the seafloor by the mooring buoys.

DESCRIPTION OF ILLUSTRATIVE EMBODIMENTS

Figure 1:
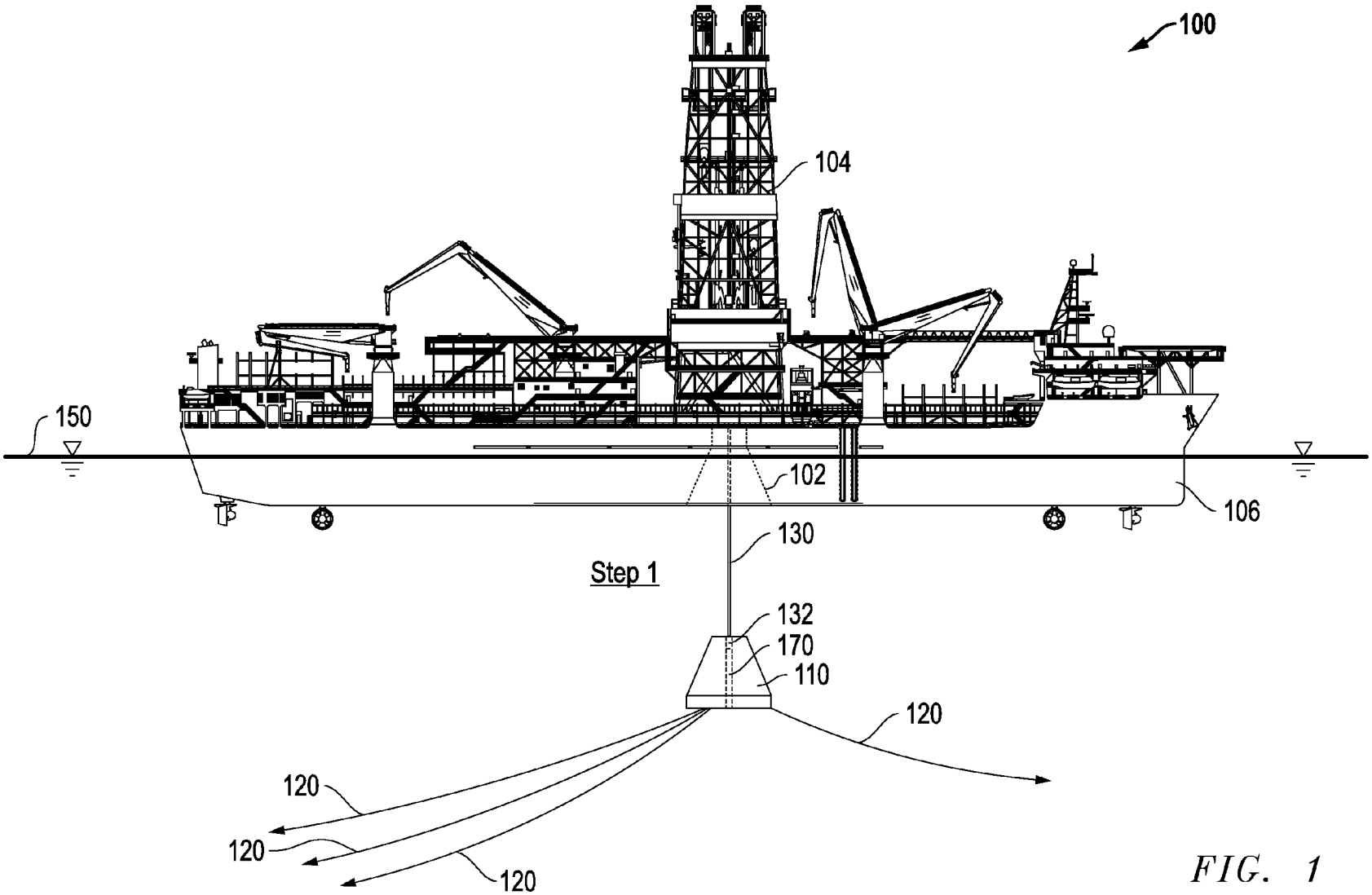
FIG. 1 illustrates a DP drillship that has been configured according to one exemplary embodiment of the disclosed systems and methods.

FIG. 1 shows a typical DP drillship 100 that has been configured according to one exemplary embodiment of the disclosed systems and methods. A conical-shaped receptacle 102 has been fitted in the ship's hull 106 directly below the drilling derrick 104 to act as a mooring buoy retention feature. A complementary shaped dockable conical-shaped buoy 110 is dimensionally configured to fit and lock into the ship's receptacle 102, e.g., using latching dogs or other suitable locking mechanism that may be selectably released when it is desired to unlock the buoy 110 from the receptacle 102. Mooring lines 120 are connected from anchors in the seafloor to the bottom of the dockable buoy 110. Buoy 110 is constructed and configured such that when the buoy 110 is in a released condition from ship 100, it will settle into an equilibrium position such as shown in FIG. 1 between the water surface 150 and the seafloor when the net buoyancy of the buoy 110 equals the net downward force components of the mooring lines 120 due to their submerged weight. This behavior keeps the released mooring buoy 110 a safe distance from any surface ice and allows the drillship 100 to position itself over the mooring buoy in preparation for re-connecting. FIG.

Figure 3:
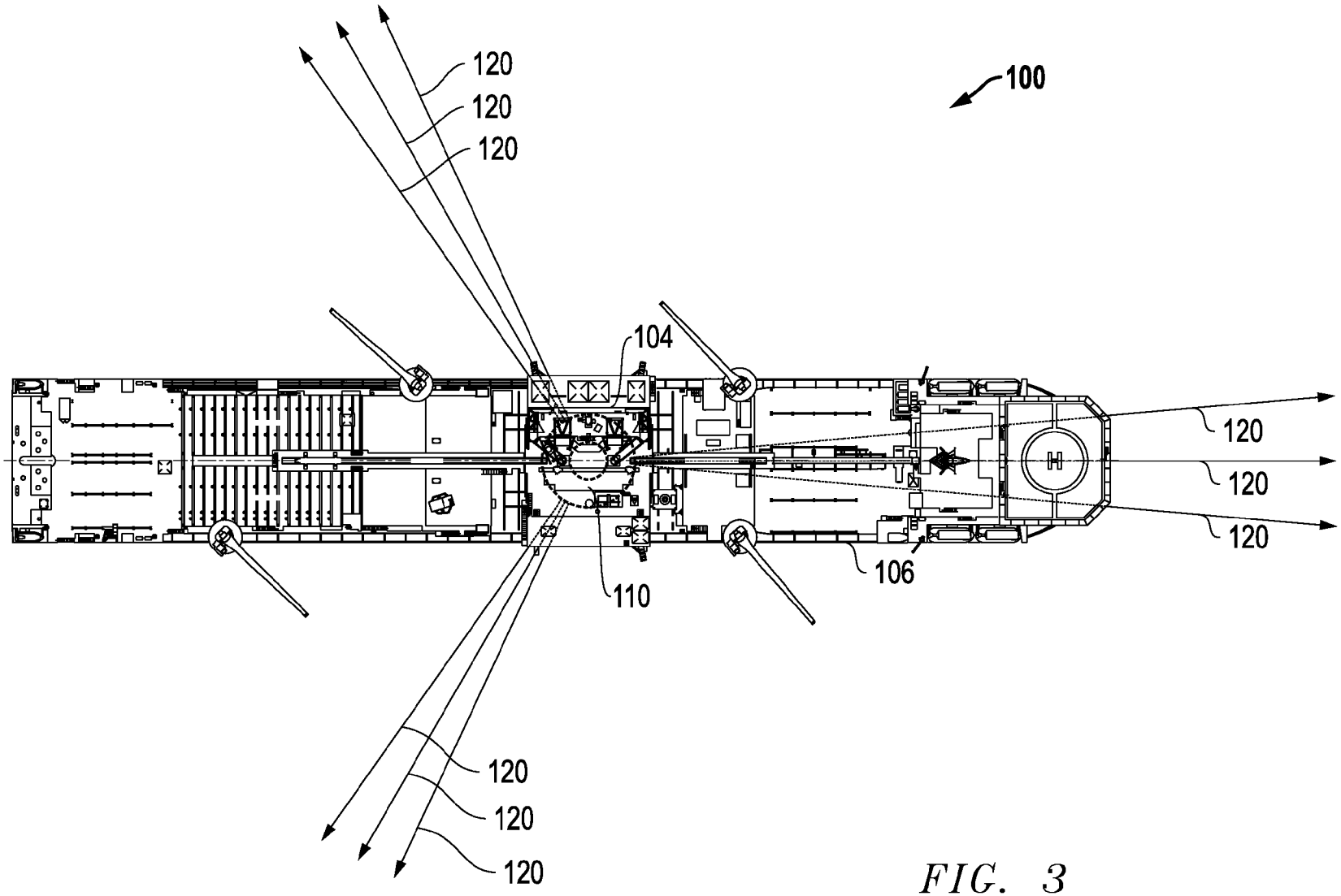
FIG. 3 illustrates a plan view of the DP vessel and mooring system of FIGS. 1 and 2 according to one exemplary embodiment of the disclosed systems and methods.

2 shows the mooring buoy 110 docked into the hull receptacle 102, and FIG. 3 shows a plan view of the vessel 100 and mooring system. It will be understood that the conical shape and dimensions of receptacle 102 and a corresponding mating buoy 110 may vary, and that in other embodiments a receptacle 102 and corresponding mating buoy 110 may have shapes other than conical. Further, the depth of the buoy equilibrium position below the water surface 150 may be selected and controlled by varying the configuration of the buoy and its construction materials.

Figure 2:
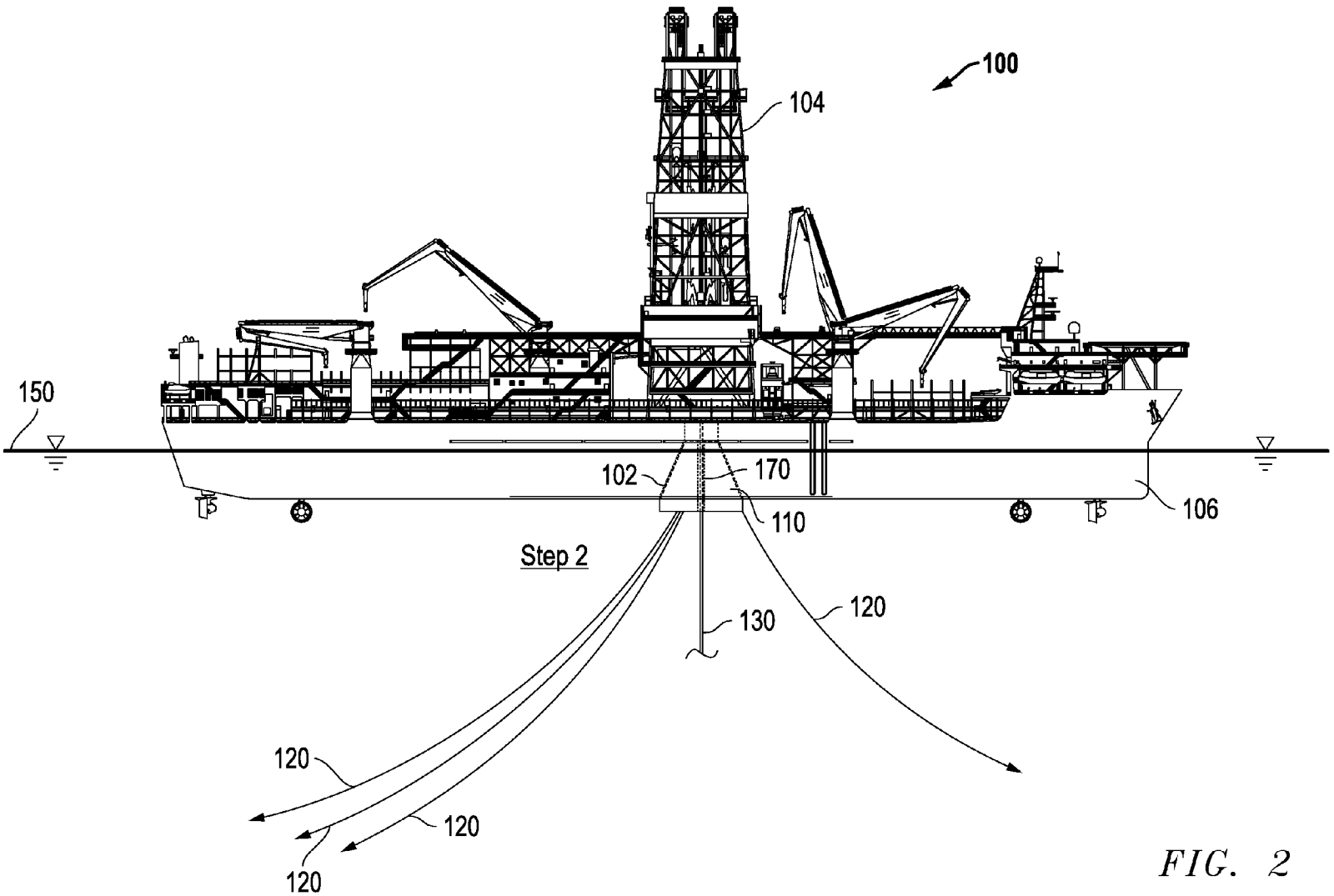
FIG. 2 illustrates a mooring buoy docked into the hull receptacle of the drillship of FIG. 2 according to one exemplary embodiment of the disclosed systems and methods.

As illustrated in FIG. 1, once positioned over the buoy, the drillship 100 may lower a retrieval mechanism (e.g. the ship's drill string 130 configured with a special J-lock connector 132 or other suitable selectably-engageable and releasable connector on the terminal end of the drill string 130). In one exemplary embodiment, a J-lock connector 132 may be connected and latched to a corresponding mating connector on the buoy 110 and then the draw works on the drilling ship 100 may use the drill string 130 to lift the buoy into the hull receptacle 102 where it is locked in place. Once mated up to the vessel 100, the mooring system is operational. In this regard, a suitably dimensioned internal opening 170 (e.g., in the form of a passageway or shaft) may in one embodiment be defined within the center of the body of buoy 110 as shown to allow the drill string 130 to pass through the docked buoy 110 (e.g., optionally together with an accompanying drilling riser that is not shown but which may surround the drill string 130), such that drilling operations may be performed with drill string 130 through buoy 110 while ship 100 is moored as depicted in FIG. 2. In such an embodiment, the opening 170 may be positioned and aligned directly beneath derrick 104 when buoy 110 is locked into place within receptacle 102. Although illustrated with single opening 170 defined in buoy 110 corresponding to a single drill string 130, it will be understood that multiple openings 170 may optionally be defined in a buoy 110 to allow multiple corresponding drill strings 130 to pass through the body of the buoy 110. Thus, for drill ships configured with a dual derrick (or other multi-string configuration) that is capable of deploying two or more drill strings simultaneously to conduct drilling operations, a buoy 110 may be optionally configured to be of sufficient size to allow multiple suitably dimensioned internal openings 170 to be defined through the body of the buoy 110 so that multiple drill strings 130 (together with one or more optional drilling risers) may simultaneously extend through the corresponding multiple openings 170 in the buoy 110 to conduct drilling operations simultaneously with the multiple drill strings 130 through the buoy 110 while ship 100 is moored.

Mooring buoy 110 of FIG. 1 may be optionally configured in one exemplary embodiment as a rotating turret that rotates in the manner of a slip ring between the hull 106 and the mooring lines 102. However, buoy 110 may alternatively be a non-rotating buoy. In either case, the vessel's DP system will be needed to maintain the vessel's heading but not to the extent that it needs to maintain the ship's position. This has the advantage of greatly reducing the vessel's fuel usage. Use of the rotating turret will have the additional benefits over a fixed turret of allowing adjustment of the vessel's heading based on prevailing wind and current directions and less danger of damage to the mooring system if the DP system malfunctions.

Figure 4A:
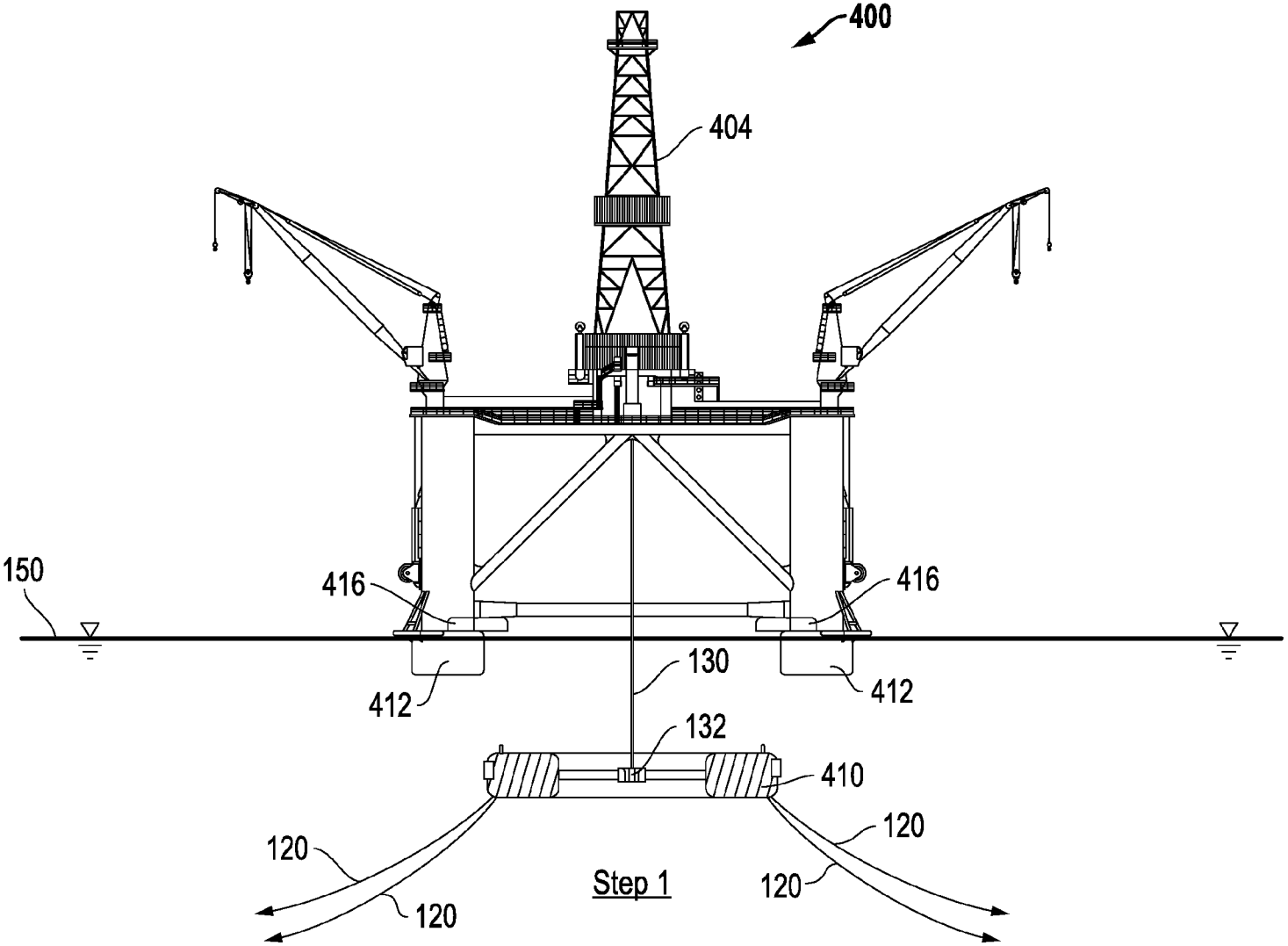
FIG. 4A illustrates a MODU and releasable mooring system for MODUs according to one exemplary embodiment of the disclosed systems and methods.
Figure 4B:
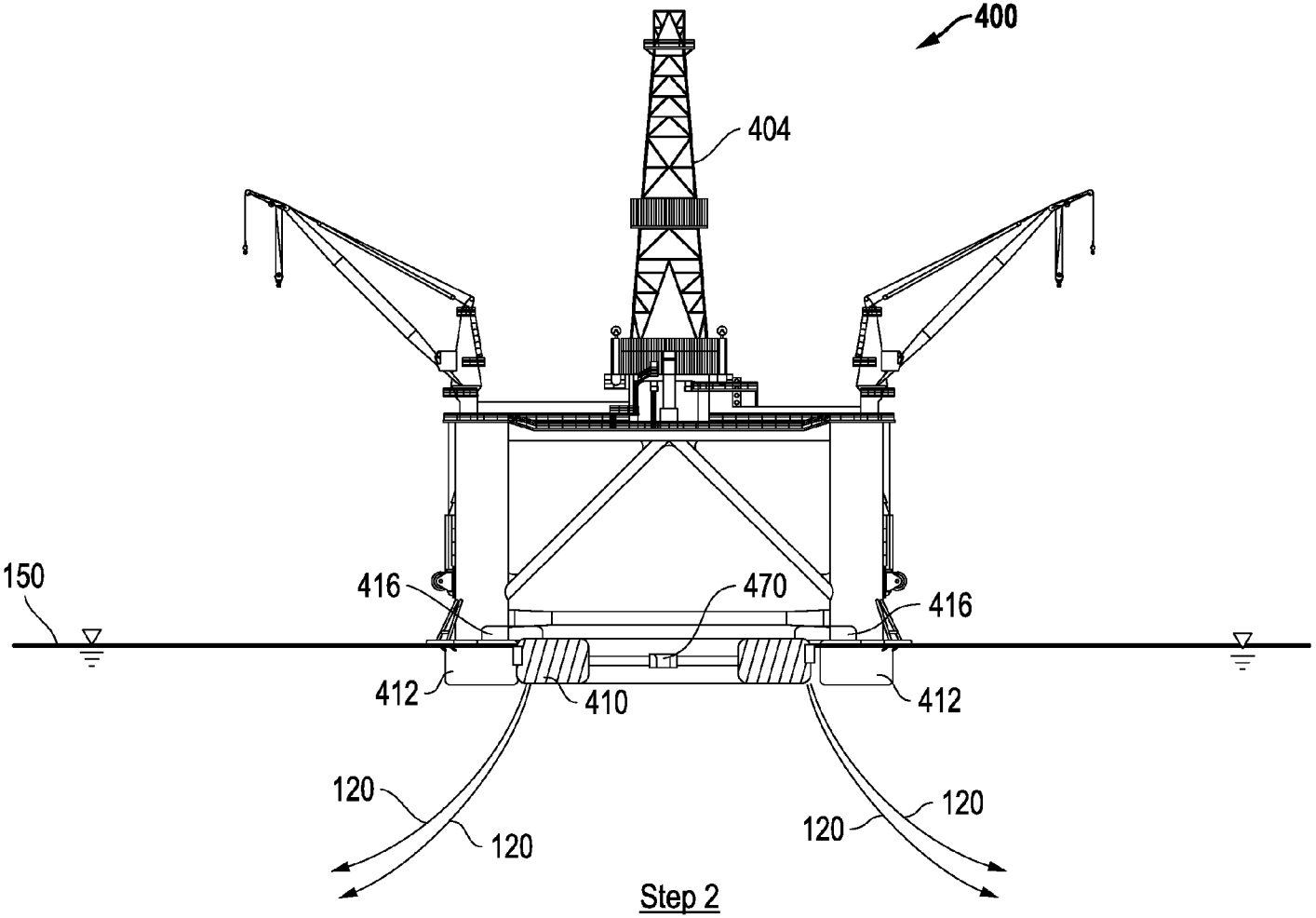
FIG. 4B illustrates a MODU and releasable mooring system for MODUs according to one exemplary embodiment of the disclosed systems and methods.
Figure 5:
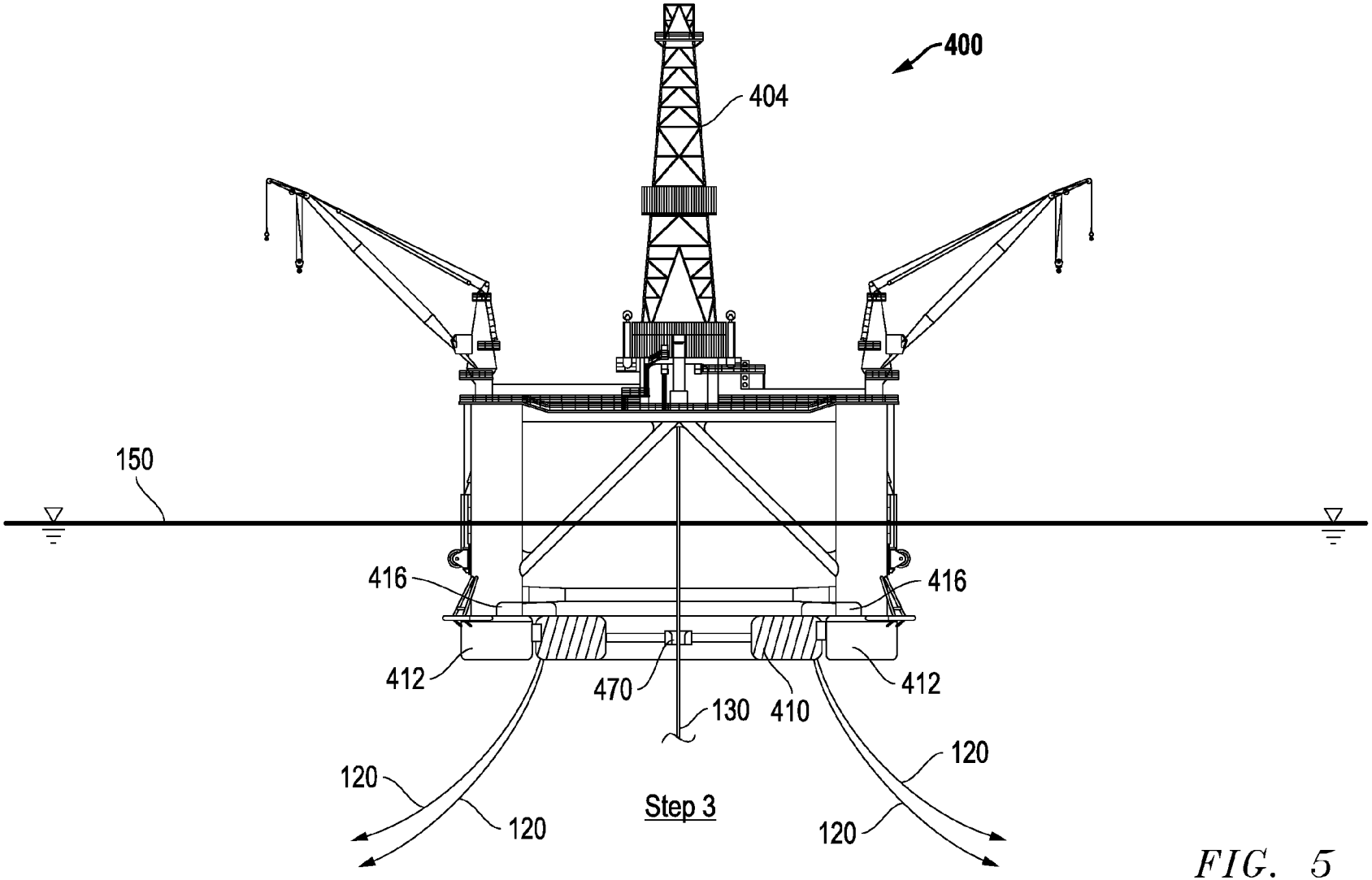
FIG. 5 illustrates the MODU of FIGS. 4A and 4B moored at operational draft according to one exemplary embodiment of the disclosed systems and methods.

FIGS. 4A and 4B illustrate one exemplary embodiment for a releasable mooring system for a MODU drilling vessel 400 having a derrick 404. In this embodiment, instead of a conical buoy, a large ring buoy 410 is configured to latch between the pontoons 412 of the MODU 400. As with the drillship embodiment of FIGS. 1-3, if the vessel 400 is in danger, the buoy 410 (shown in cross section in FIGS. 4A and 4B) may be quickly released from latched engagement with MODU 400, in which case it is constructed and configured to sink to its equilibrium depth away from the water surface in a manner similar to that previously described. When the MODU 400 returns, it may maintain station over the buoy 410, e.g., either by the use of thrusters or with the assistance of its anchor handling tug. As with the embodiment of FIGS. 1-3, the drill string 130 may be lowered with a special J-lock connector 132 (or other suitable selectably-engageable and releasable connector) on the bottom of drill string 130 that will connect and latch to a corresponding mating connector provided in the center of buoy 410 for that purpose. Then the MODU's draw works may be employed to retrieve the drill string 130 to lift the buoy 410 and dock it into corresponding hangers 416 provided on the MODU pontoons 412 that act as mooring buoy retention features. At this stage the MODU 400 is effectively moored and ready to commence drilling operations. The re-connect operation is shown being accomplished in FIGS. 4A and 4B with the MODU 400 at transit draft. FIG. 5 shows the moored MODU 400 at operational draft, with drill string 130 extending through buoy 410 for drilling operations.

Figure 6:
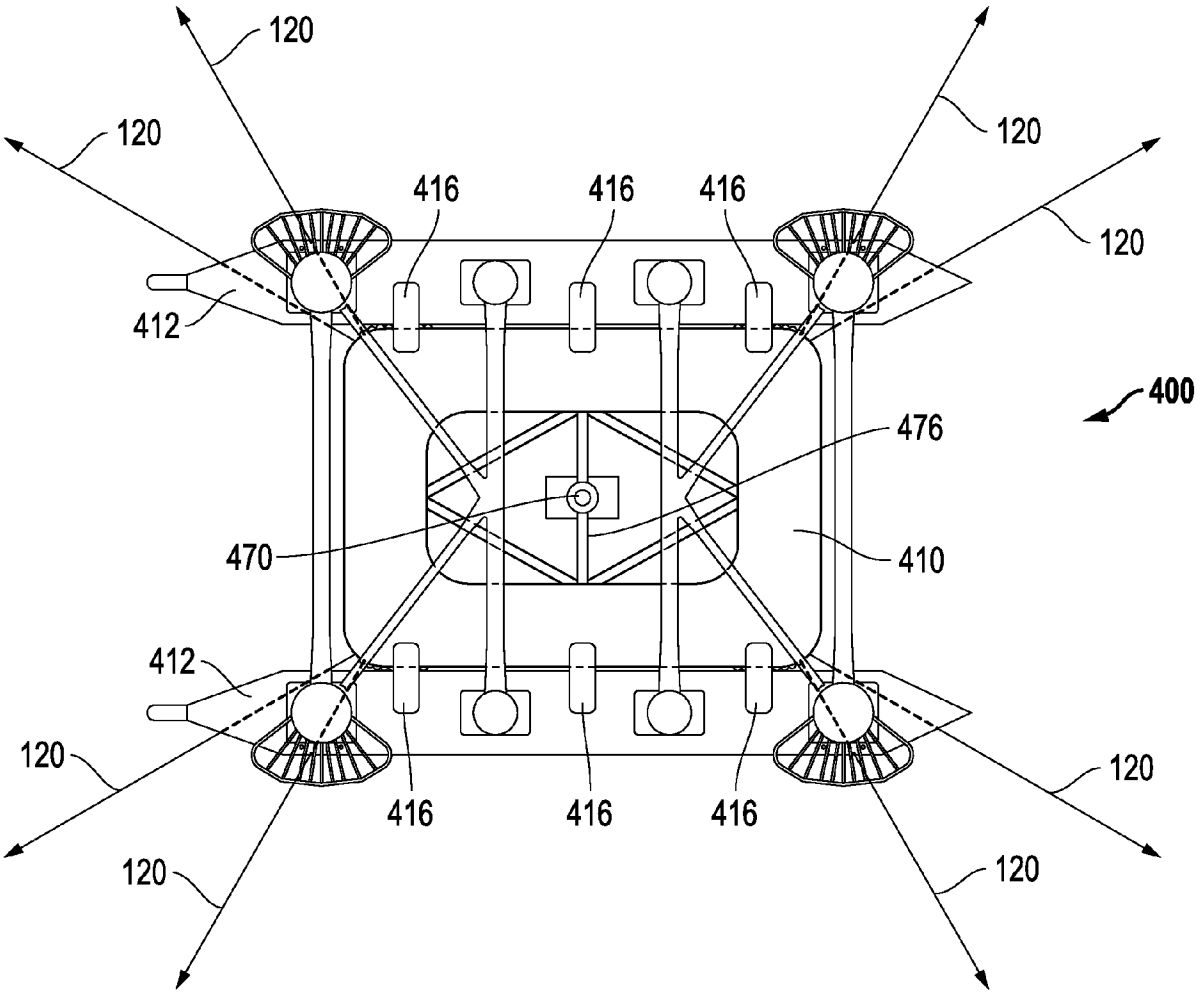
FIG. 6 shows a plan view of the MODU of FIGS. 4 and 5 according to one exemplary embodiment of the disclosed systems and methods.

FIG. 6 shows a plan view of the ring buoy 410 of FIGS. 4-5 (with derrick 404 and related upper assembly of MODU 400 not visible), illustrating opening 470 that may be provided in the structural cross members 476 at the center of the buoy 410 as shown to allow the drill string 130 to pass through the docked buoy 410 to allow drilling operations to be performed with drill string 130 through buoy 410 while MODU 400 is moored as depicted in FIG. 5. It will be understood that these structural cross members are exemplary only, and that they may be absent in other embodiments, in which case drill string 130 may pass through the large opening in the center of the ring buoy 410.

Figure 7A:
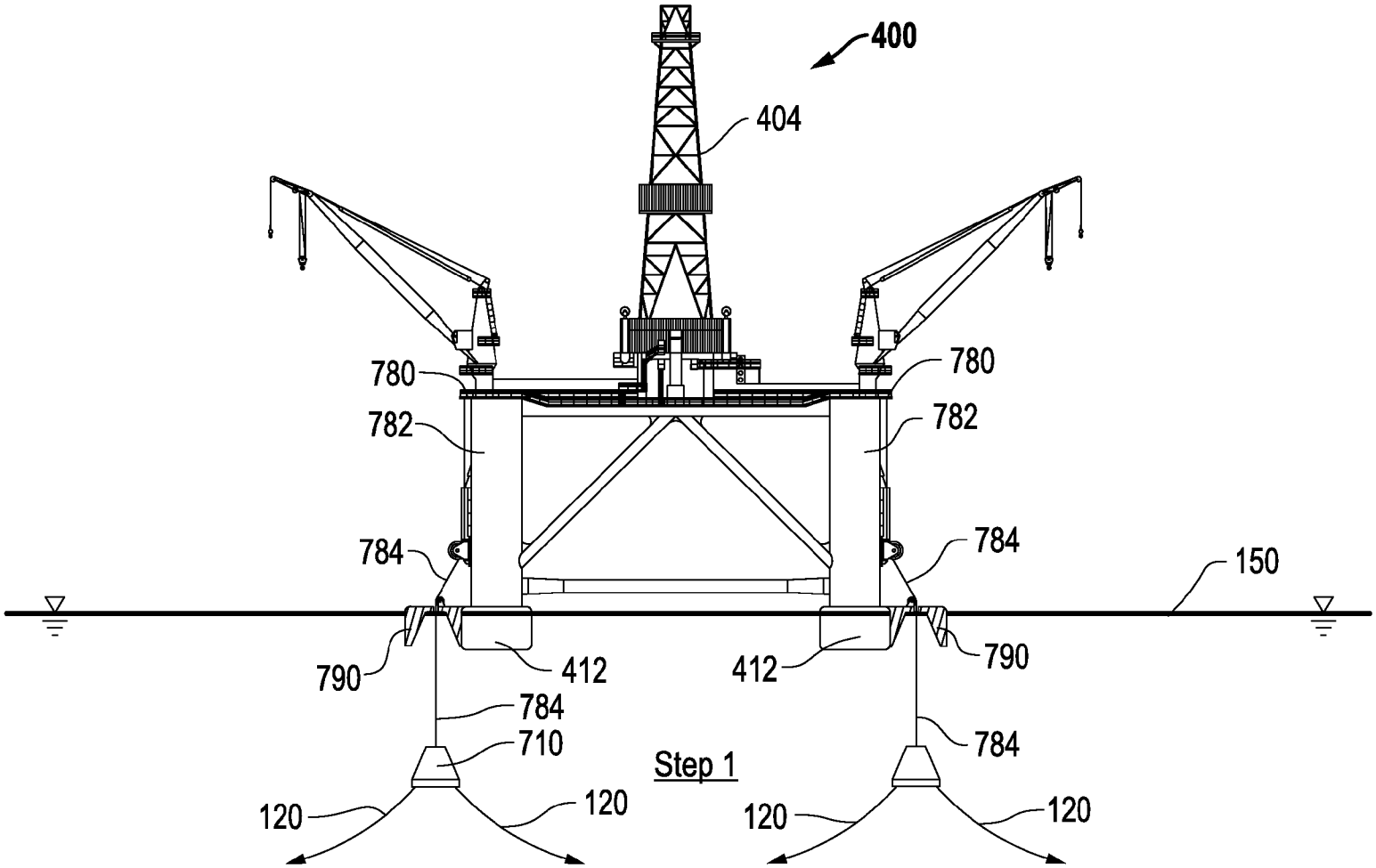
FIG. 7A illustrates a MODU and releasable mooring system for MODUs according to another exemplary embodiment of the disclosed systems and methods.
Figure 7B:
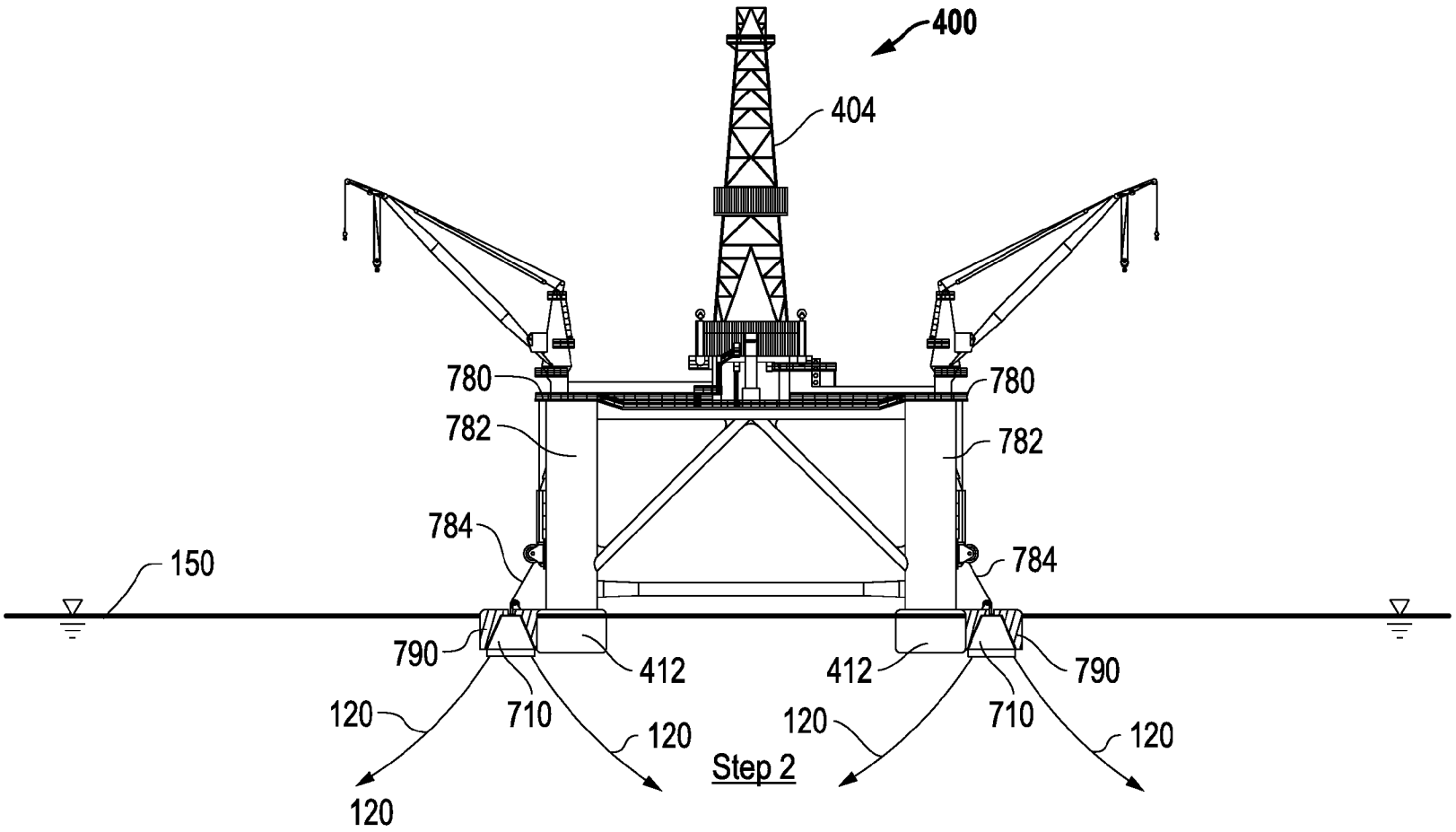
FIG. 7B illustrates a MODU and releasable mooring system for MODUs according to another exemplary embodiment of the disclosed systems and methods.
Figure 8:
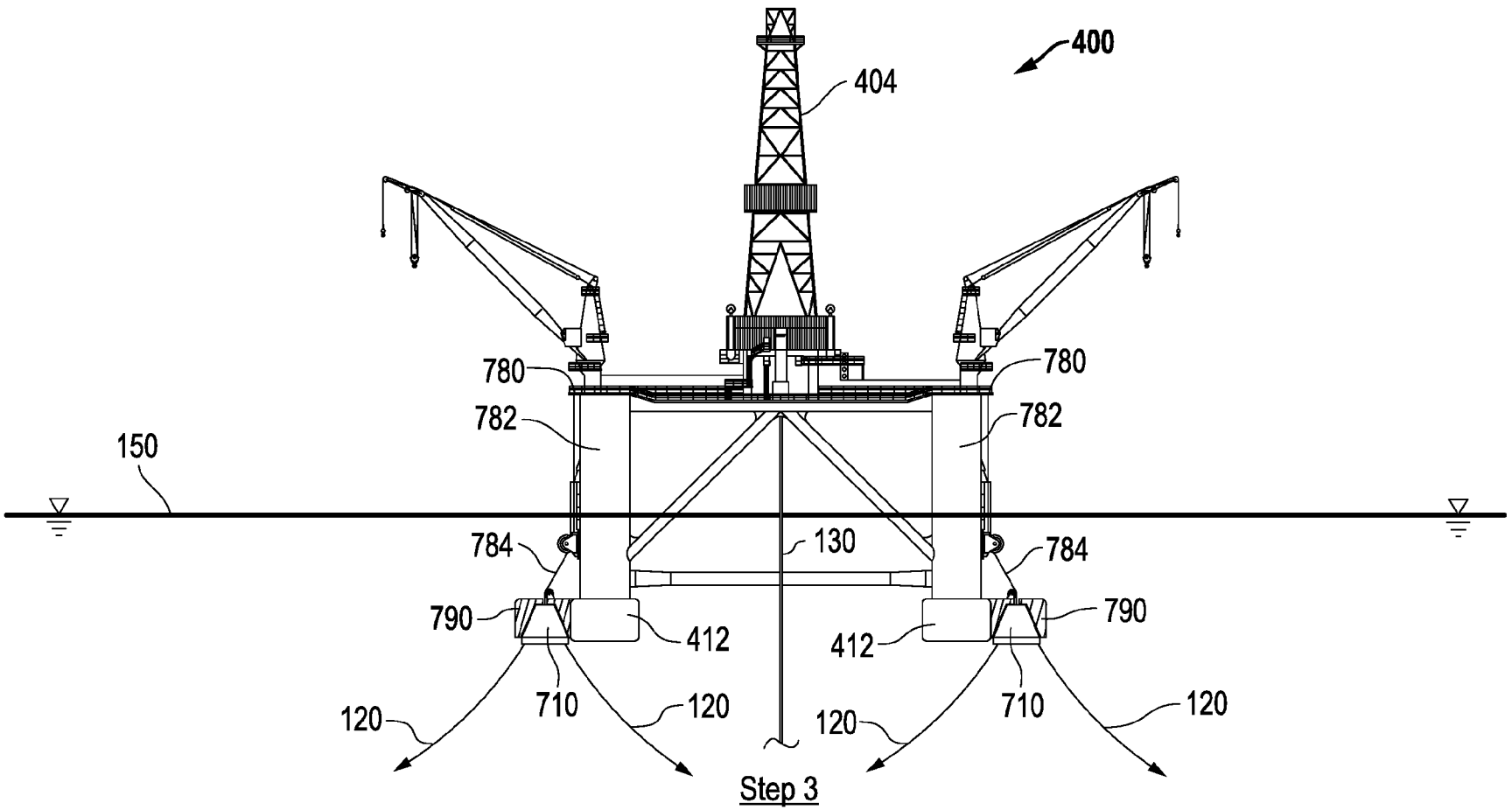
FIG. 8 illustrates the MODU of FIGS. 7A and 7B moored at operational draft according to one exemplary embodiment of the disclosed systems and methods.
Figure 9:
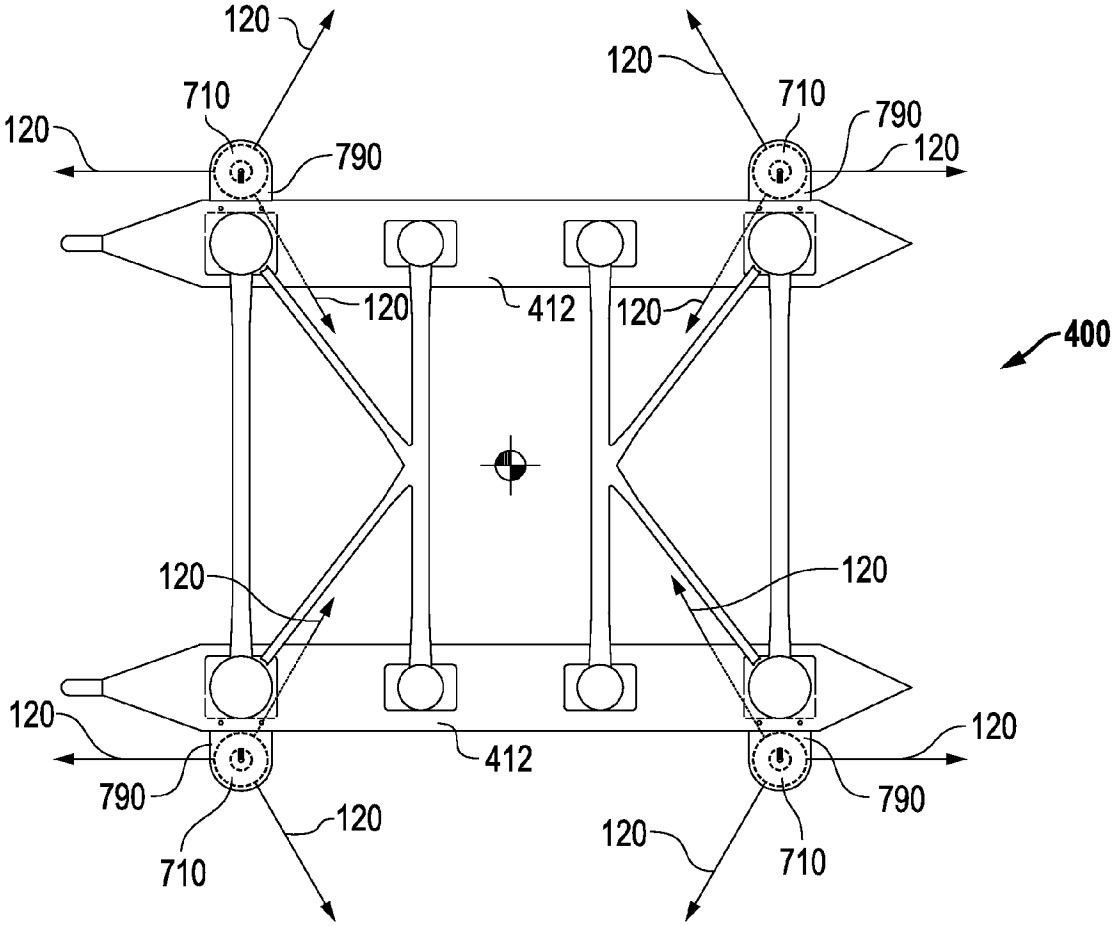
FIG. 9 shows a plan view of the MODU of FIGS. 7 and 8 according to one exemplary embodiment of the disclosed systems and methods.

FIGS. 7A and 7B illustrate another exemplary embodiment for a releasable mooring system for a MODU drilling vessel 400. In this exemplary embodiment, multiple (e.g., four) dockable conical mooring buoys 710 may be utilized to dock and latch into four corresponding external hull receptacles 790 (shown in cross section) that act as a mooring buoy retention feature mechanically coupled to pontoons 412 as shown. As before, the buoys 710 are easily released if danger (e.g., ice or other hazard) approaches and are constructed and configured to sink to equilibrium depth away from the water surface in a manner similar to that previously described. When returning to re-connect, the MODU 400 may position itself over the four underwater buoys 710 while at transit draft and lines 784 from the anchor winches 780 on the four corner columns (not shown in drawing) 782 may be used to pull the buoys 710 into their respective receptacles 790. A remotely operated vehicle (ROV) may be optionally used to connect the retrieval lines to the mooring buoys. FIG. 8 shows the MODU 400 at operational draft ready to commence drilling activities with mooring buoys 710 latched in place, and FIG. 9 shows a plan view of the embodiment of FIGS. 7-8 (with derrick 404 and related upper assembly of MODU 400 not visible).

Figure 10A:
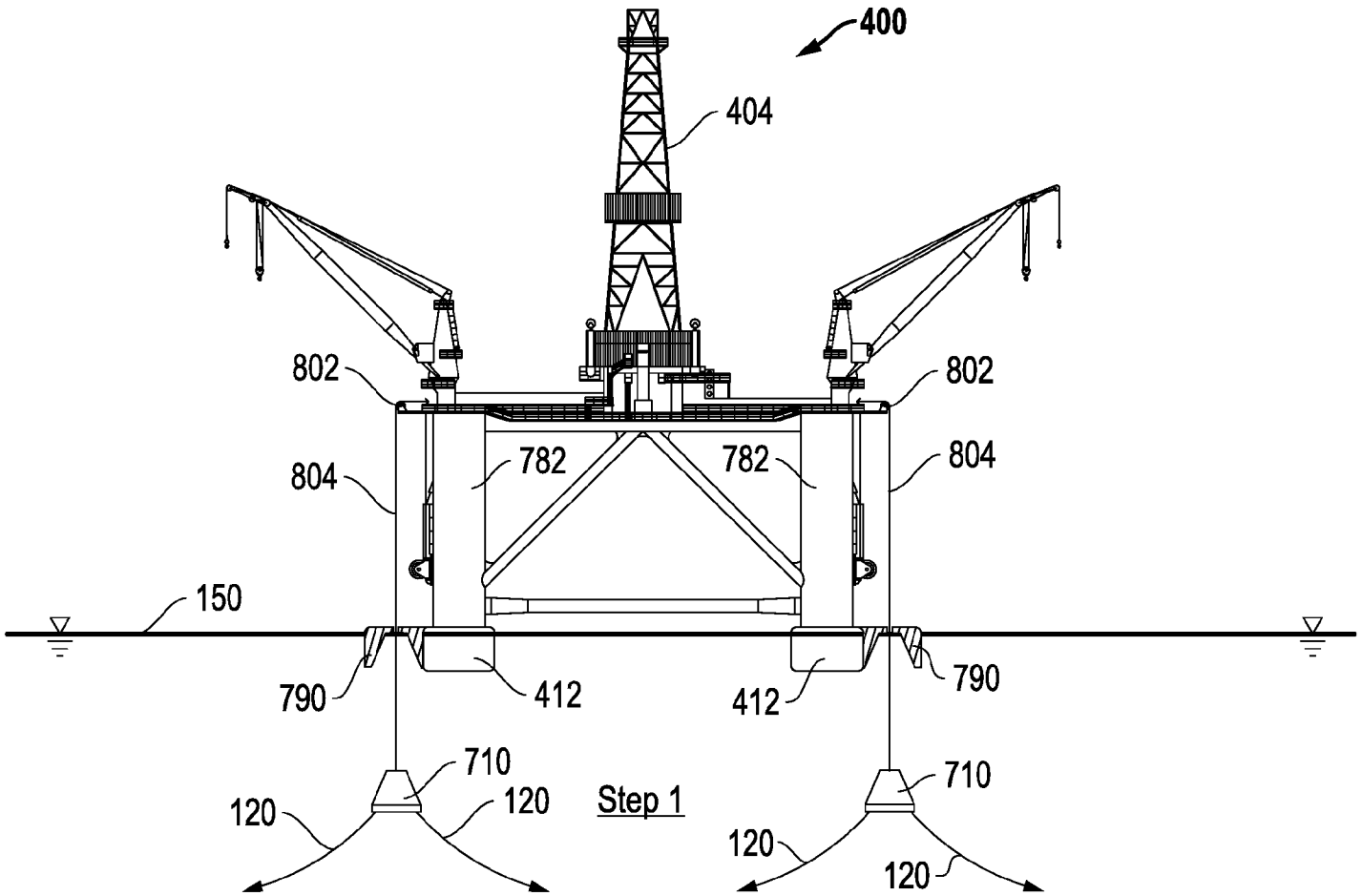
FIG. 10A illustrates a MODU and releasable mooring system for MODUs according to another exemplary embodiment of the disclosed systems and methods.
Figure 10B:
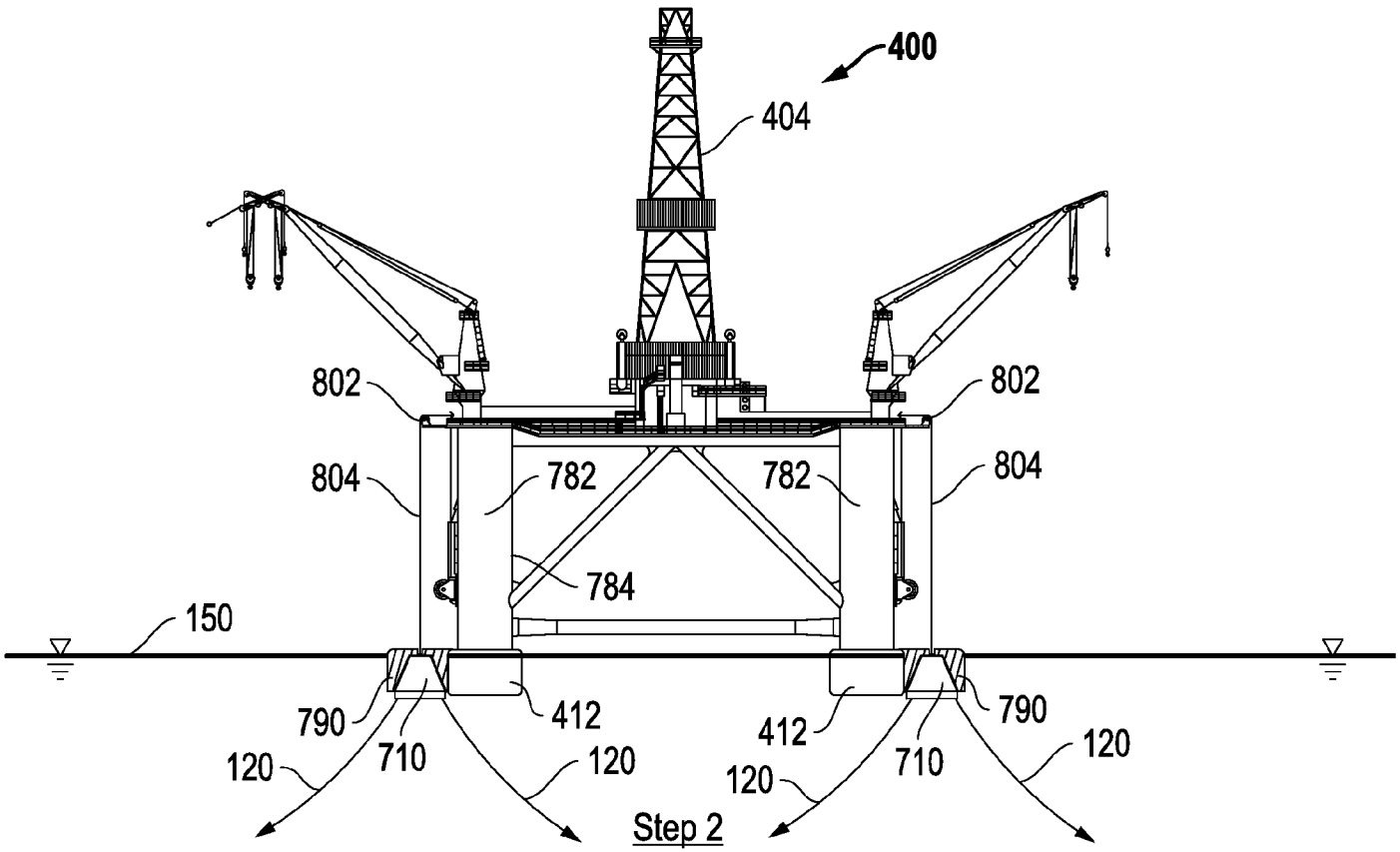
FIG. 10B illustrates a MODU and releasable mooring system for MODUs according to another exemplary embodiment of the disclosed systems and methods.
Figure 11:
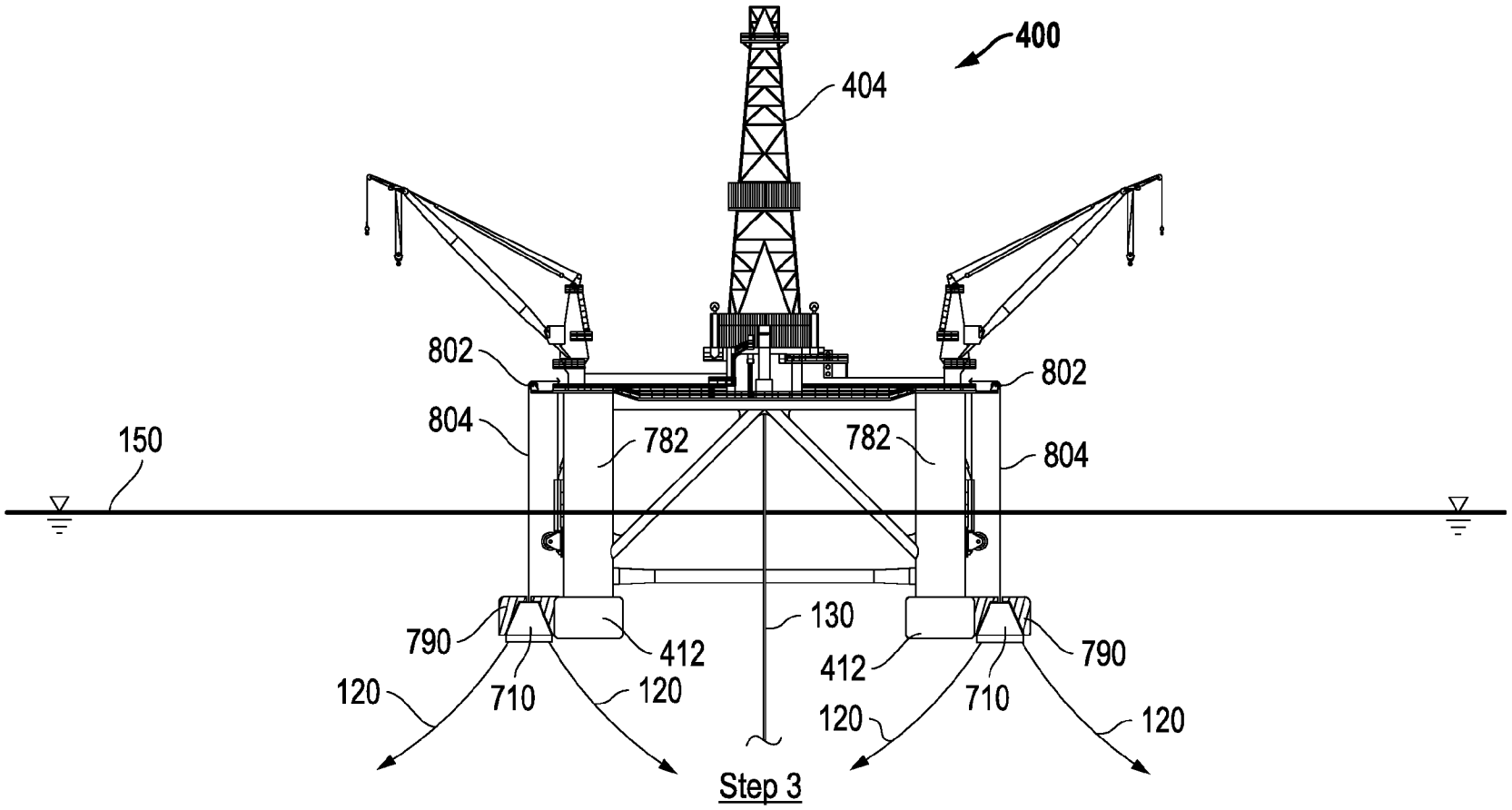
FIG. 11 illustrates the MODU of FIGS. 10A and 10B moored at operational draft according to one exemplary embodiment of the disclosed systems and methods.
Figure 12:
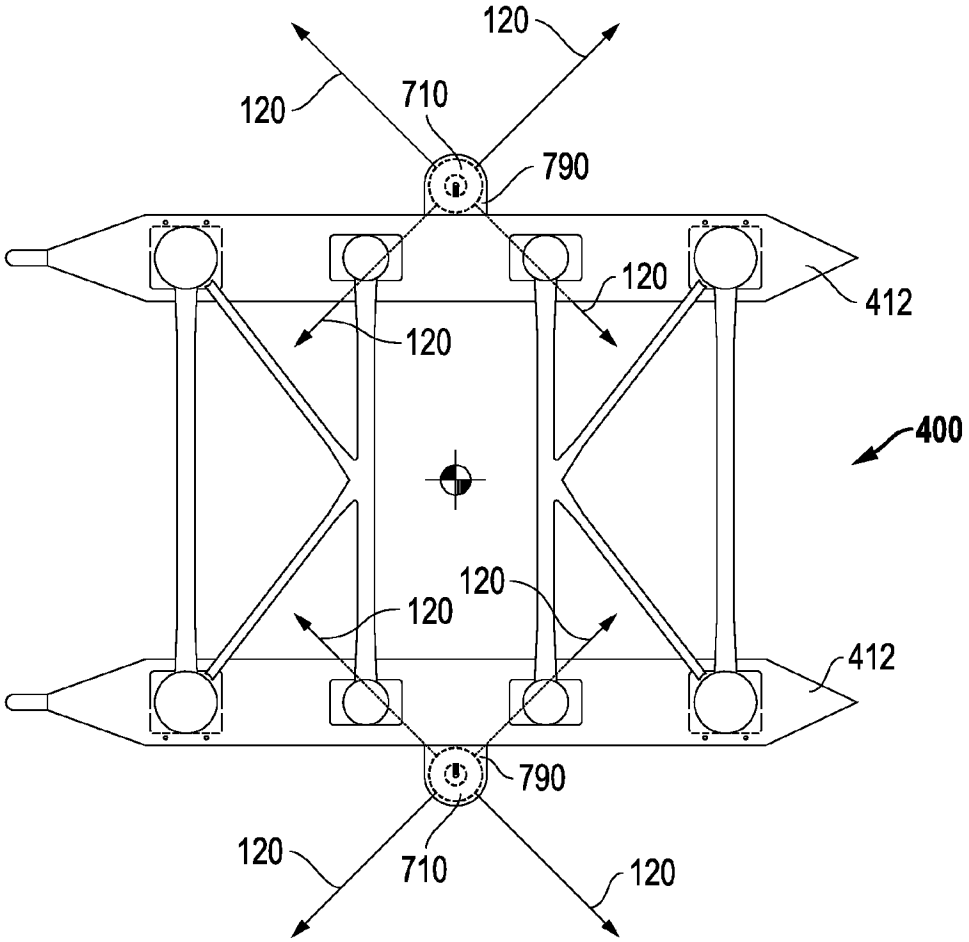
FIG. 12 shows a plan view of the MODU of FIGS. 10 and 11 according to one exemplary embodiment of the disclosed systems and methods.

It will be understood that the number of multiple buoys 710 employed to moor a MODU may vary. For example, FIGS. 10A and 10B illustrate another exemplary embodiment similar to the MODU embodiment of FIGS. 7-9 but in which only two mooring buoys 710 are used. FIG. 11 shows the MODU vessel 400 at operational draft with mooring buoys 710 locked in place in corresponding external hull receptacles 790 (shown in cross section), and FIG. 12 shows a plan view of this embodiment (with derrick 404 and related upper assembly of MODU 400 not visible). In the embodiment of FIGS. 10-12, the two buoys 710 may be centered longitudinally along the outside of the vessel's two pontoons 412 as illustrated in FIG. 12. It will be understood that additional deck machinery (e.g., winches 802 and winch lines 804) may be required to pull in the buoys 710 for those MODU vessels 400 that do not already have anchor winches or other suitable machinery in this area of the deck of the MODU 400.

It is noted that the number of mooring lines may vary for the mooring buoys of the disclosed systems and methods. For example, each buoy 710 uses four mooring lines 120 in the embodiment of FIGS. 10-12 in lieu of the 3 mooring lines 120 used per buoy 710 in the four-buoy embodiment of FIGS. 7-9. In all MODU embodiments, DP may be optionally employed if and when needed to help maintain position of a MODU 400 during mooring and drilling operations, although it is more likely that a reduced amount of DP (or substantially no DP operations at all) may be required during drilling operations for those embodiments employing a greater number of buoys 710.

While the invention may be adaptable to various modifications and alternative forms, specific examples and exemplary embodiments have been shown by way of example and described herein. However, it should be understood that the invention is not intended to be limited to the particular forms disclosed. Rather, the invention is to cover all modifications, equivalents, and alternatives falling within the spirit and scope of the systems and methods described herein. Moreover, the different aspects of the disclosed systems and methods may be utilized in various combinations and/or independently. Thus the invention is not limited to only those combinations shown herein, but rather may include other combinations.

What is claimed is:

1. A releasable mooring system for a seagoing drilling vessel configured to conduct drilling operations below the surface of the water with a drill string, the system comprising:

at least one dockable mooring buoy configured for coupling to one or more mooring lines anchored to a seafloor, the at least one mooring buoy having a buoyancy configured to float in the water at an equilibrium depth between a surface and the seafloor;

where the at least one dockable mooring buoy is configured to be engaged and retained in at least one retention feature provided on the seagoing drilling vessel to moor the vessel to the seafloor during drilling operations in which a drill string extends from the drilling vessel to the seafloor;

where the at least one dockable mooring buoy is provided with a connection feature to allow the seagoing drilling vessel to connect to and retrieve the at least one mooring buoy into selectable locking engagement with the at least one retention feature to moor the vessel to the seafloor for the drilling operations;

where:

an opening is defined through the at least one mooring buoy to allow the drill string to pass through the at least one mooring buoy to the seafloor to conduct drilling operations while the drilling vessel is moored to the seafloor by the at least one mooring buoy, or where the at least one dockable mooring buoy comprises multiple mooring buoys configured for engagement and retention in multiple corresponding respective retention features provided on the drilling vessel in positions that provide clearance to allow the drill string to extend downward from the moored drilling vessel to conduct drilling operations while the drilling vessel is moored to the seafloor by the mooring buoys;

where the at least one dockable mooring buoy is configured to be selectably released from locking engagement with the at least one retention feature to release the vessel from being moored to the seafloor; and where the at least one retention feature is a conical-shaped receptacle; and where the at least one dockable mooring buoy is a complementary shaped dockable conical-shaped buoy that is dimensionally configured to fit and lock into the conical-shaped receptacle.

2. The system of claim 1, where the seagoing drilling vessel comprises a drillship having a derrick and draw works; where the at least one retention feature is integral to a hull of the drillship and positioned immediately beneath the derrick and draw works and comprises a receptacle that is shaped and dimensioned to receive a single dockable mooring buoy in locking engagement therein to moor the drillship to the seafloor for the drilling operations; where the mooring buoy comprises a centrally positioned connector to selectably connect to a mating connector on the drill string for retrieval of the mooring buoy by the draw works into a position for locking engagement within the receptacle; and where an opening is defined through the mooring buoy to allow the drill string to pass through the mooring buoy to the seafloor to conduct drilling operations while the drillship is moored to the seafloor by the mooring buoy.

3. The system of claim 2, where the at least one mooring buoy is a rotating turret that is rotatable between the hull and the mooring lines while the drillship is moored to the seafloor by the at least one mooring buoy.

4. The system of claim 1, where an opening is defined through the at least one mooring buoy to allow the drill string to pass through the at least one mooring buoy to the seafloor to conduct drilling operations while the drilling vessel is moored to the seafloor by the at least one mooring buoy.

5. The system of claim 1, where the at least one dockable mooring buoy comprises multiple mooring buoys configured for engagement and retention in multiple corresponding respective retention features provided on the drilling vessel in positions that provide clearance to allow the drill string to extend downward from the moored drilling vessel to conduct drilling operations while the drilling vessel is moored to the seafloor by the mooring buoys.

6. A releasable mooring system and seagoing drilling vessel, comprising:

a seagoing drilling vessel configured to conduct drilling operations below the surface of the water with a drill string;

at least one dockable mooring buoy configured for coupling to one or more mooring lines anchored to a seafloor, the mooring buoy having a buoyancy configured to float in the water at an equilibrium depth between a surface and the seafloor; and at least one retention feature provided on the seagoing drilling vessel;

where the at least one dockable mooring buoy is configured to be engaged and retained in the at least one retention feature to moor the vessel to the seafloor during drilling operations in which the drill string extends from the drilling vessel to the seafloor;

where the at least one dockable mooring buoy is provided with a connection feature to allow the seagoing drilling vessel to connect to and retrieve the at least one mooring buoy into selectable locking engagement with the at least one retention feature to moor the vessel to the seafloor for the drilling operations; and where the at least one dockable mooring buoy is configured to be selectably released from locking engagement with the at least one retention feature to release the vessel from being moored to the seafloor;

where the at least one retention feature is a conical-shaped receptacle; and where the at least one dockable mooring buoy is a complementary shaped dockable conical-shaped buoy that is dimensionally configured to fit and lock into the conical-shaped receptacle.

7. The system of claim 6, where:

an opening is defined through the at least one mooring buoy to allow the drill string to pass through the mooring buoy to the seafloor to conduct drilling operations while the drilling vessel is moored to the seafloor by the at least one mooring buoy, or where the at least one dockable mooring buoy comprises multiple mooring buoys configured for engagement and retention in multiple corresponding respective retention features provided on the drilling vessel in positions that provide clearance to allow the drill string to extend downward from the moored drilling vessel to conduct drilling operations while the drilling vessel is moored to the seafloor by the mooring buoys.

8. The system of claim 6, where an opening is defined through the at least one mooring buoy to allow the drill string to pass through the at least one mooring buoy to the seafloor to conduct drilling operations while the drilling vessel is moored to the seafloor by the at least one mooring buoy.

9. The system of claim 6, where the at least one dockable mooring buoy comprises multiple mooring buoys configured for engagement and retention in multiple corresponding respective retention features provided on the drilling vessel in positions that provide clearance to allow the drill string to extend downward from the moored drilling vessel to conduct drilling operations while the drilling vessel is moored to the seafloor by the mooring buoys.

10. A method of conducting mooring operations for a seagoing drilling vessel, the method comprising:

providing a drilling vessel on the surface of a body of water, the drilling vessel having at least one retention feature and the drilling vessel being configured to conduct drilling operations below the surface of the water with a drill string;

providing at least one dockable mooring buoy coupled to one or more mooring lines anchored to a seafloor, the at least one mooring buoy having a buoyancy configured to float in the water at an equilibrium depth between a surface and the seafloor;

positioning the drilling vessel over the at least one mooring buoy while the buoy is floating in the water at an equilibrium depth between a surface and the seafloor;

using a connection feature to connect to and retrieve the at least one mooring buoy, and engaging and retaining the at least one dockable mooring buoy into locking engagement with the at least one retention feature with the one or more mooring lines coupled between the at least one mooring buoy and the seafloor so as to moor the vessel to the seafloor with the one or more mooring lines; and releasing the dockable mooring buoy from locking engagement with the at least one retention feature to release the vessel from being moored to the seafloor;

where an opening is defined through the at least one mooring buoy to allow the drill string to pass through the mooring buoy to the seafloor to conduct drilling operations while the drilling vessel is moored to the seafloor by the at least one mooring buoy;

where the at least one retention feature is a conical-shaped receptacle, and where the at least one dockable mooring buoy is a complementary shaped dockable conical-shaped buoy that is dimensionally configured to fit and lock into the conical-shaped receptacle.

11. A method of conducting mooring operations for a seagoing drilling vessel, the method comprising:

providing a drilling vessel on the surface of a body of water, the drilling vessel having at least one retention feature and the drilling vessel being configured to conduct drilling operations below the surface of the water with a drill string;

providing at least one dockable mooring buoy coupled to one or more mooring lines anchored to a seafloor, the at least one mooring buoy having a buoyancy configured to float in the water at an equilibrium depth between a surface and the seafloor;

positioning the drilling vessel over the at least one mooring buoy while the buoy is floating in the water at an equilibrium depth between a surface and the seafloor;

using a connection feature to connect to and retrieve the at least one mooring buoy, and engaging and retaining the at least one dockable mooring buoy into locking engagement with the at least one retention feature with the one or more mooring lines coupled between the at least one mooring buoy and the seafloor so as to moor the vessel to the seafloor with the one or more mooring lines; and releasing the dockable mooring buoy from locking engagement with the at least one retention feature to release the vessel from being moored to the seafloor;

where the at least one dockable mooring buoy comprises multiple mooring buoys configured for engagement and retention in multiple corresponding respective retention features provided on the drilling vessel in positions that provide clearance to allow the drill string to extend downward from the moored drilling vessel to conduct drilling operations while the drilling vessel is moored to the seafloor by the mooring buoys; and where each of the retention features is a conical-shaped receptacle; and where each of the dockable mooring buoys is a complementary shaped dockable conical-shaped buoy that is dimensionally configured to fit and lock into a corresponding one of the conical-shaped receptacles.

12. A releasable mooring system for a seagoing drilling vessel configured to conduct drilling operations below the surface of the water with a drill string, the system comprising:

at least one dockable mooring buoy configured for coupling to one or more mooring lines anchored to a seafloor, the at least one mooring buoy having a buoyancy configured to float in the water at an equilibrium depth between a surface and the seafloor;

where the at least one dockable mooring buoy is configured to be engaged and retained in at least one retention feature provided on the seagoing drilling vessel to moor the vessel to the seafloor during drilling operations in which a drill string extends from the drilling vessel to the seafloor;

where the at least one dockable mooring buoy is provided with a connection feature to allow the seagoing drilling vessel to connect to and retrieve the at least one mooring buoy into selectable locking engagement with the at least one retention feature to moor the vessel to the seafloor for the drilling operations;

where:

an opening is defined through the at least one mooring buoy to allow the drill string to pass through the at least one mooring buoy to the seafloor to conduct drilling operations while the drilling vessel is moored to the seafloor by the at least one mooring buoy, or where the at least one dockable mooring buoy comprises multiple mooring buoys configured for engagement and retention in multiple corresponding respective retention features provided on the drilling vessel in positions that provide clearance to allow the drill string to extend downward from the moored drilling vessel to conduct drilling operations while the drilling vessel is moored to the seafloor by the mooring buoys;

where the at least one dockable mooring buoy is configured to be selectably released from locking engagement with the at least one retention feature to release the vessel from being moored to the seafloor; and where the dockable mooring buoy is provided with a connection feature configured to be connected and latched by a mating connector on the drill string to allow the seagoing drilling vessel to lower the drill string and use the drill string to connect to and retrieve the at least one mooring buoy into selectable locking engagement with the at least one retention feature to moor the vessel to the seafloor.

13. The system of claim 12, where the seagoing drilling vessel comprises a mobile offshore drilling unit (MODU) having a flotation pontoon on each of two opposing sides of the MODU and having a derrick and draw works positioned between the two floatation pontoons; where the at least one mooring buoy comprises a ring buoy; where the at least one retention feature comprises at least one hanger mechanism provided on each of the floatation platforms that is configured to receive a portion of the at least one mooring buoy in locking engagement therewith to moor the MODU to the seafloor for the drilling operations; where the at least one mooring buoy comprises a centrally positioned connector to selectably connect to a mating connector on the drill string for retrieval of the at least one mooring buoy by the draw works into a position for locking engagement with the hanger mechanisms on each of the two flotation platforms; and where an opening is defined through the at least one mooring buoy to allow the drill string to pass through the at least one mooring buoy to the seafloor to conduct drilling operations while the MODU is moored to the seafloor by the at least one mooring buoy.

14. A method of conducting mooring operations for a seagoing drilling vessel, the method comprising:

providing a drilling vessel on the surface of a body of water, the drilling vessel having at least one retention feature and the drilling vessel being configured to conduct drilling operations below the surface of the water with a drill string;

providing at least one dockable mooring buoy coupled to one or more mooring lines anchored to a seafloor, the at least one mooring buoy having a buoyancy configured to float in the water at an equilibrium depth between a surface and the seafloor;

positioning the drilling vessel over the at least one mooring buoy while the at least one buoy is floating in the water at an equilibrium depth between a surface and the seafloor;

using a connection feature to connect to and retrieve the at least one mooring buoy, and engaging and retaining the at least one dockable mooring buoy into locking engagement with the at least one retention feature to moor the vessel to the seafloor;

conducting drilling operations from the drilling vessel with the drill string extended from the drilling vessel to the seafloor while the at least one mooring buoy is engaged and retained in the at least one retention feature to moor the vessel to the seafloor;

releasing the at least one dockable mooring buoy from locking engagement with the at least one retention feature to release the vessel from being moored to the seafloor; and using the seagoing drilling vessel to lower the drill string and use the drill string to connect to and retrieve the at least one mooring buoy into selectable locking engagement with the at least one retention feature to moor the vessel to the seafloor.

15. A method of conducting mooring operations for a seagoing drilling vessel, the method comprising:

providing a drilling vessel on the surface of a body of water, the drilling vessel having at least one retention feature and the drilling vessel being configured to conduct drilling operations below the surface of the water with a drill string;

providing at least one dockable mooring buoy coupled to one or more mooring lines anchored to a seafloor, the at least one mooring buoy having a buoyancy configured to float in the water at an equilibrium depth between a surface and the seafloor;

positioning the drilling vessel over the at least one mooring buoy while the at least one buoy is floating in the water at an equilibrium depth between a surface and the seafloor;

using a connection feature to connect to and retrieve the at least one mooring buoy, and engaging and retaining the at least one dockable mooring buoy into locking engagement with the at least one retention feature to moor the vessel to the seafloor;

conducting drilling operations from the drilling vessel with the drill string extended from the drilling vessel to the seafloor while the at least one mooring buoy is engaged and retained in the at least one retention feature to moor the vessel to the seafloor; and releasing the at least one dockable mooring buoy from locking engagement with the at least one retention feature to release the vessel from being moored to the seafloor;

where the seagoing drilling vessel comprises a mobile offshore drilling unit (MODU) having a flotation pontoon on each of two opposing sides of the MODU and having a derrick and draw works positioned between the two floatation pontoons; where the at least one mooring buoy comprises a ring buoy; where the at least one retention feature comprises at least one hanger mechanism provided on each of the two floatation platforms that is configured to receive a portion of the at least one mooring buoy in locking engagement therewith to moor the MODU to the seafloor for the drilling operations; where the at least one mooring buoy comprises a centrally positioned connector to selectably connect to a mating connector on the drill string for retrieval of the at least one mooring buoy by the draw works into a position for locking engagement with the hanger mechanisms on each of the two flotation platforms; where an opening is defined through the at least one mooring buoy to allow the drill string to pass through the at least one mooring buoy to the seafloor to conduct drilling operations while the MODU is moored to the seafloor by the at least one mooring buoy; and where the method further comprises:

using the draw works to lower the drill string to connect to and retrieve the at least one mooring buoy by the draw works into locking engagement with the hanger mechanisms on each of the two flotation platforms, and then using the draw works to lower the drill string through the at least one mooring buoy to the seafloor to conduct drilling operations while the MODU is moored to the seafloor by the at least one mooring buoy.

16. A method of conducting mooring operations for a seagoing drilling vessel, the method comprising:

providing a drilling vessel on the surface of a body of water, the drilling vessel having at least one retention feature and the drilling vessel being configured to conduct drilling operations below the surface of the water with a drill string;

providing at least one dockable mooring buoy coupled to one or more mooring lines anchored to a seafloor, the at least one mooring buoy having a buoyancy configured to float in the water at an equilibrium depth between a surface and the seafloor;

positioning the drilling vessel over the at least one mooring buoy while the at least one buoy is floating in the water at an equilibrium depth between a surface and the seafloor;

using a connection feature to connect to and retrieve the at least one mooring buoy, and engaging and retaining the at least one dockable mooring buoy into locking engagement with the at least one retention feature to moor the vessel to the seafloor;

conducting drilling operations from the drilling vessel with the drill string extended from the drilling vessel to the seafloor while the at least one mooring buoy is engaged and retained in the at least one retention feature to moor the vessel to the seafloor; and releasing the at least one dockable mooring buoy from locking engagement with the at least one retention feature to release the vessel from being moored to the seafloor;

where the seagoing drilling vessel comprises a mobile offshore drilling unit (MODU) having a flotation pontoon on each of two opposing sides of the MODU and having a derrick and draw works positioned between the two floatation pontoons; where each of the retention features comprises an external hull receptacle corresponding to one of the multiple separate mooring buoys, with at least one of the external hull receptacles being mechanically coupled to each respective one of the two floatation pontoons and being shaped and dimensioned to receive one of the separate dockable mooring buoys in locking engagement therein to moor the MODU to the seafloor for the drilling operations; and where each given one of the separate mooring buoys is configured for retrieval of the given mooring buoy into a position for locking engagement within the external hull receptacle corresponding to the given mooring buoy to moor the MODU to the seafloor for the drilling operations in a position that provides clearance to allow the drill string to extend downward from the moored MODU to conduct drilling operations while the MODU is moored to the seafloor by the mooring buoy; and where the method further comprises:

retrieving each of the multiple mooring buoys into a position for locking engagement within a corresponding one of the external hull receptacles to moor the MODU to the seafloor, and then extending the drill string downward from the moored MODU to conduct drilling operations while the MODU is moored to the seafloor by the multiple mooring buoys; and where each of the retention features is a conical-shaped receptacle; and where each of the dockable mooring buoys is a complementary shaped dockable conical-shaped buoy that is dimensionally configured to fit and lock into a corresponding one of the conical-shaped receptacles.

17. A method of conducting mooring operations for a seagoing drilling vessel, the method comprising:

providing a drilling vessel on the surface of a body of water, the drilling vessel having at least one retention feature and the drilling vessel being configured to conduct drilling operations below the surface of the water with a drill string;

providing at least one dockable mooring buoy coupled to one or more mooring lines anchored to a seafloor, the at least one mooring buoy having a buoyancy configured to float in the water at an equilibrium depth between a surface and the seafloor;

positioning the drilling vessel over the at least one mooring buoy while the at least one buoy is floating in the water at an equilibrium depth between a surface and the seafloor;

using a connection feature to connect to and retrieve the at least one mooring buoy, and engaging and retaining the at least one dockable mooring buoy into locking engagement with the at least one retention feature to moor the vessel to the seafloor;

conducting drilling operations from the drilling vessel with the drill string extended from the drilling vessel to the seafloor while the at least one mooring buoy is engaged and retained in the at least one retention feature to moor the vessel to the seafloor; and releasing the at least one dockable mooring buoy from locking engagement with the at least one retention feature to release the vessel from being moored to the seafloor;

where the at least one retention feature is a conical-shaped receptacle; where the at least one dockable mooring buoy is a complementary shaped dockable conical-shaped buoy that is dimensionally configured to fit and lock into the conical-shaped receptacle; and where the method further comprises engaging and retaining the dockable conical-shaped mooring buoy into locking engagement with the conical-shaped receptacle to moor the vessel to the seafloor with the one or more mooring lines coupled between the mooring buoy and the seafloor so as to moor the vessel to the seafloor with the one or more mooring lines.

18. The method of claim 17, where:

an opening is defined through the at least one mooring buoy and where the method further comprises passing the drill string through the at least one mooring buoy to the seafloor to conduct the drilling operations while the drilling vessel is moored to the seafloor by the at least one mooring buoy; or where the at least one dockable mooring buoy comprises multiple mooring buoys configured for engagement and retention in multiple corresponding respective retention features provided on the drilling vessel in positions that provide clearance to allow the drill string to extend downward from the moored drilling vessel and where the method comprises engaging and retaining each of the multiple dockable mooring buoys into locking engagement with a corresponding one of the multiple retention features to moor the vessel to the seafloor and extending the drill string downward to conduct the drilling operations while the drilling vessel is moored to the seafloor by the mooring buoys.

19. The method of claim 17, where an opening is defined through the at least one mooring buoy; and where the method further comprises passing the drill string through the at least one mooring buoy to the seafloor to conduct the drilling operations while the drilling vessel is moored to the seafloor by the at least one mooring buoy.

20. The method of claim 17, where the at least one dockable mooring buoy comprises multiple mooring buoys configured for engagement and retention in multiple corresponding respective retention features in positions provided on the drilling vessel that provide clearance to allow the drill string to extend downward from the moored drilling vessel; and where the method comprises engaging and retaining each of the multiple dockable mooring buoys into locking engagement with a corresponding one of the multiple retention features to moor the vessel to the seafloor and extending the drill string downward to conduct the drilling operations while the drilling vessel is moored to the seafloor by the mooring buoys.

21. A releasable mooring system for a seagoing drilling vessel configured to conduct drilling operations below the surface of the water with a drill string, the system comprising:

multiple dockable mooring buoys configured for coupling to one or more mooring lines anchored to a seafloor, each of the mooring buoys having a buoyancy configured to float in the water at an equilibrium depth between a surface and the seafloor;

where each of the dockable mooring buoys is configured to be engaged and retained in at least one retention feature provided on the seagoing drilling vessel to moor the seagoing drilling vessel to the seafloor during drilling operations in which the drill string extends from the seagoing drilling vessel to the seafloor;

where each of the dockable mooring buoys is provided with a connection feature to allow the seagoing drilling vessel to connect to and retrieve the mooring buoy into selectable locking engagement with a corresponding retention feature to moor the seagoing drilling vessel to the seafloor for the drilling operations;

where each of the dockable mooring buoys is configured to be selectably released from locking engagement with the corresponding retention feature to release the seagoing drilling vessel from being moored to the seafloor;

where the seagoing drilling vessel comprises a mobile offshore drilling unit (MODU) having a flotation pontoon on each of two opposing sides of the MODU and having a derrick and draw works positioned between the two floatation pontoons; where each of the retention features comprises an external hull receptacle corresponding to one of the multiple separate mooring buoys, with at least one of the external hull receptacles being mechanically coupled to each of the two floatation pontoons and being shaped and dimensioned to receive one of the separate dockable mooring buoys in locking engagement therein to moor the MODU to the seafloor for the drilling operations; and where each given one of the separate mooring buoys is configured for retrieval of the given mooring buoy into a position for locking engagement within the external hull receptacle corresponding to the given mooring buoy to moor the MODU to the seafloor for the drilling operations in a position that provides clearance to allow the drill string to extend downward from the moored MODU to conduct drilling operations while the MODU is moored to the seafloor by the mooring buoy; and where each of the retention features is a conical-shaped receptacle; and where each of the dockable mooring buoys is a complementary shaped dockable conical-shaped buoy that is dimensionally configured to fit and lock into a corresponding one of the conical-shaped receptacles.

22. The system of claim 21, where the external hull receptacles comprise at least four external hull receptacles, each of the four external hull receptacles being mechanically coupled at a corresponding end of each of the two floatation pontoons; where the multiple separate mooring buoys comprise at least four separate mooring buoys, each given one of the four separate mooring buoys being configured for retrieval of the given mooring buoy into a position for locking engagement within a corresponding one of the four external hull receptacle receptacles to moor the MODU to the seafloor for the drilling operations in a position that provides clearance to allow the drill string to extend downward from the moored MODU to conduct drilling operations while the MODU is moored to the seafloor by the at least four separate mooring buoys.

* * * * *